US006478609B1

(12) United States Patent
Davis et al.

(10) Patent No.: US 6,478,609 B1
(45) Date of Patent: Nov. 12, 2002

(54) STRAIN RELIEF ASSEMBLY

(75) Inventors: Wayne Samuel Davis, Harrisburg, PA (US); Robert Neil Whiteman, Jr., Middletown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 53 days.

(21) Appl. No.: 09/678,422

(22) Filed: Oct. 2, 2000

(51) Int. Cl.[7] ..... H01R 13/58
(52) U.S. Cl. ..... 439/470; 439/465; 439/467
(58) Field of Search ..... 439/470, 459, 439/460, 465, 467, 464

(56) References Cited

U.S. PATENT DOCUMENTS

| | | | | |
|---|---|---|---|---|
| 3,638,169 A | | 1/1972 | Caveney et al. | |
| 3,879,099 A | * | 4/1975 | Shaffer | 439/470 |
| 3,998,514 A | | 12/1976 | Hardesty | |
| 4,035,051 A | | 7/1977 | Guy | |
| 4,130,330 A | | 12/1978 | Chandler | |
| 4,280,746 A | * | 7/1981 | Ignatowicz | 439/470 |
| 4,606,596 A | | 8/1986 | Whiting et al. | |
| 4,749,369 A | | 6/1988 | Wang | 439/459 |
| 4,900,277 A | | 2/1990 | Inaba et al. | 439/752 |
| 5,266,048 A | | 11/1993 | Brekosky et al. | 439/470 |
| 5,839,911 A | | 11/1998 | Dinkel | 439/470 |
| 6,126,478 A | * | 10/2000 | Presson et al. | 439/467 |

OTHER PUBLICATIONS

Molex, 4.20mm (.165") Pitch Mini–Fit, Jr.™ Strain Relief, 3 pages.

* cited by examiner

*Primary Examiner*—Tho D. Ta

(57) ABSTRACT

A strain relief assembly (10) for an electrical connector (84) includes a connector receiving frame (12) dimensioned to receive an electrical connector (84) along an insertion axis (A); a pair of members (26, 56) hingedly secured to and extending from the frame (12), the members (26, 56) being securable together to define a wire receiving cavity (24); and at least one cable securing arm (38, 68) extending outwardly from each of the hinged members (26, 56) to a leading end. Each leading arm end is dimensioned to surround at least a portion of the cable (98).

19 Claims, 6 Drawing Sheets

FIG. 1
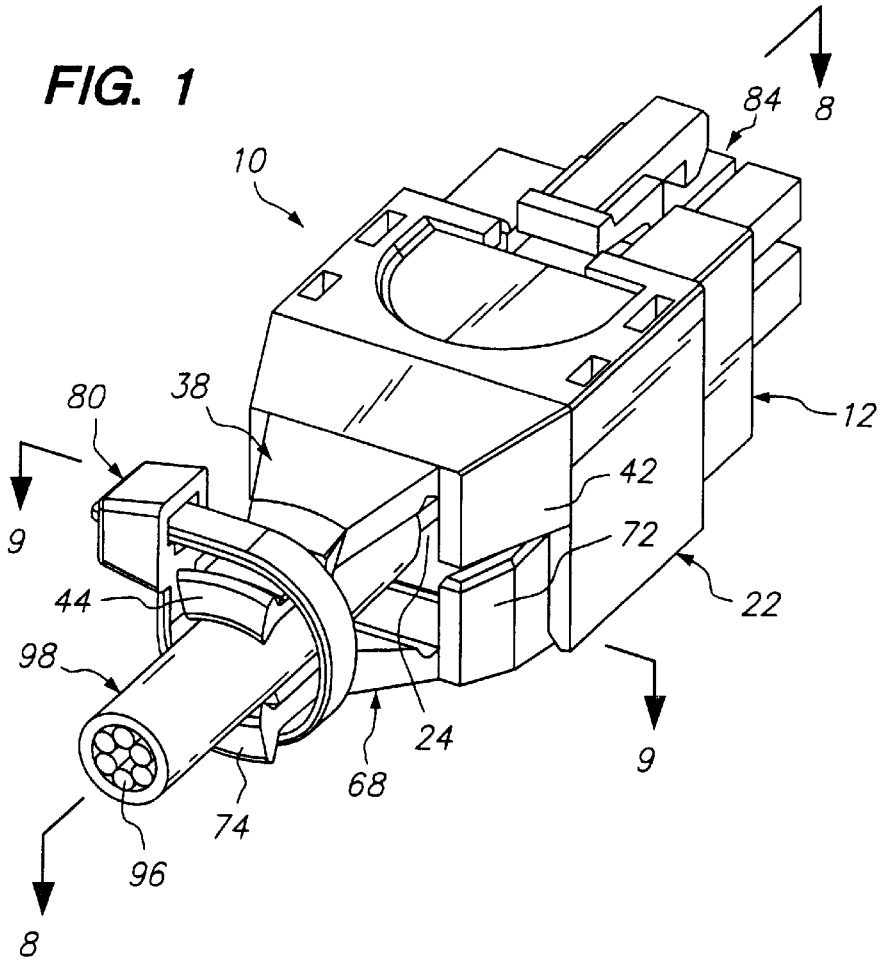
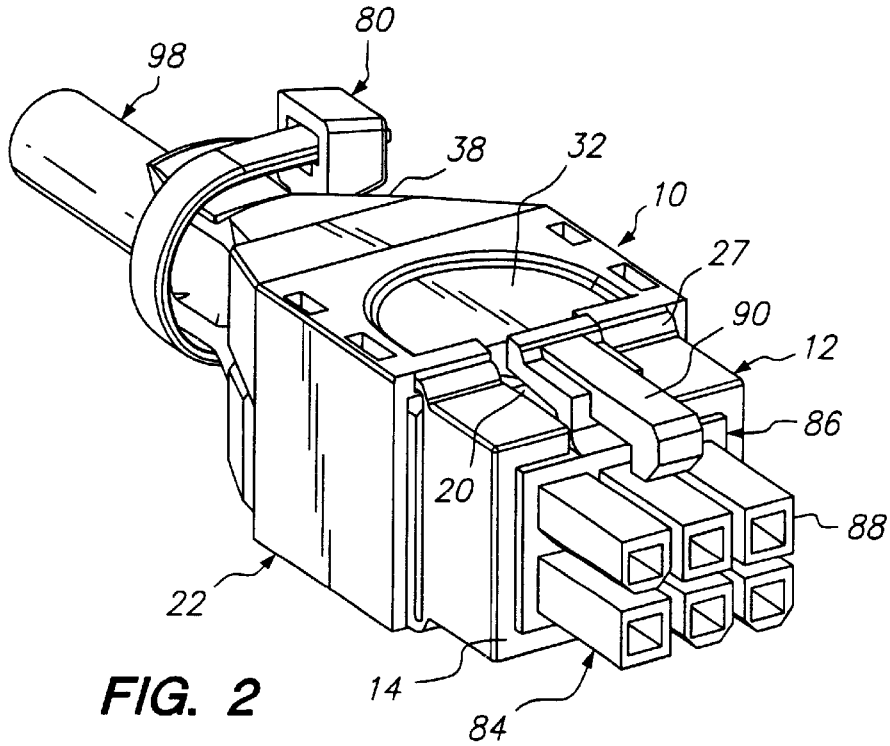
FIG. 2

STRAIN RELIEF ASSEMBLY

FIELD OF THE INVENTION

The present invention is directed to electrical connectors and more particularly to a strain relief assembly for connectors having terminals terminated to wires of a cable.

BACKGROUND OF THE INVENTION

It is well known in the art to use a strain relief for electrical connectors terminated to wires or a cable to minimize stress on the cable and terminated wires. Such connectors are generally referred to as "cable connectors". Typically the strain relief apparatus includes two separate members that are securable around the housing and wires. The separate members may be secured together by a variety of methods, such as, external hardware or interlocking features on the two members. Attaching the strain relief to the connector requires that the connector and wires be positioned in one of the members and then securing the second member to the first member without disturbing the position of the connector and wires. U.S. Pat. No. 4,749,369 discloses a two member strain relief assembly having a sliding clip wherein the two members latch together and the clip is used to secure the cable or wires exiting from the assembly. U.S. Pat. Nos. 4,606,596 and 4,900,277 disclose strain relief apparatuses that include two major members, each securable to special features provided on the connector housings, the members subsequently being securable to one another. In order to use these strain relief apparatuses it is necessary to modify the connector housings to provide the features needed to secure the two members to the housings.

SUMMARY OF THE INVENTION

The present invention is directed to a strain relief assembly that alleviates problems associated with the prior art. The strain relief assembly for an electrical connector includes a housing and a plurality of terminals terminated to respective wires of at least one cable extending from the connector. The strain relief assembly includes a connector receiving frame having a forward face and a rearward face perpendicular to an insertion axis, the frame being dimensioned to receive an electrical connector along an insertion axis ; a pair of members hingedly secured to and extending from the frame wherein in a first, open position the members extend divergently to each other and to the axis of insertion and in a second, closed position the members extend in the same direction and are substantially parallel to the insertion axis, the members being securable together to define a wire receiving cavity; and at least one cable securing arm extending outwardly from each of the hinged members to a leading end, each leading end being dimensioned to surround at least a portion of the cable. Upon securing the hinged members together the electrical connector is held securely in the frame while permitting the position of the wires to be adjusted within the wire receiving cavity prior to securing the arms to the cable thus facilitating attachment of the strain relief assembly to the connector and cable.

The strain relief apparatus of the present invention is molded in a single piece with the frame being configured to receive the desired electrical connector. There is no need to provide any special features on the housing of the cable connector. The frame includes features that prevent forward movement of the connector and the hinged members include features that prevent rearward movement of the connector when the hinged members are secured together. The connector can be secured in place prior to adjustment of the wires within the wire receiving cavity, prior to securing the cable receiving arms to the wires or cable, thereby facilitating assembly.

Embodiments of the invention will now be described by way of example with reference to the accompanying drawings.

BRIEF DESCRIPTION OF THE DRAWINGS

FIG. 1 is an isometric view of the strain relief assembly made in accordance with the invention secured to a connector and a cable extending from the connector.

FIG. 2 is a view similar to that of FIG. 1 as viewed from the mating face of the connector.

DETAILED DESCRIPTION OF AN EMBODIMENT OF THE INVENTION

Figure 3:
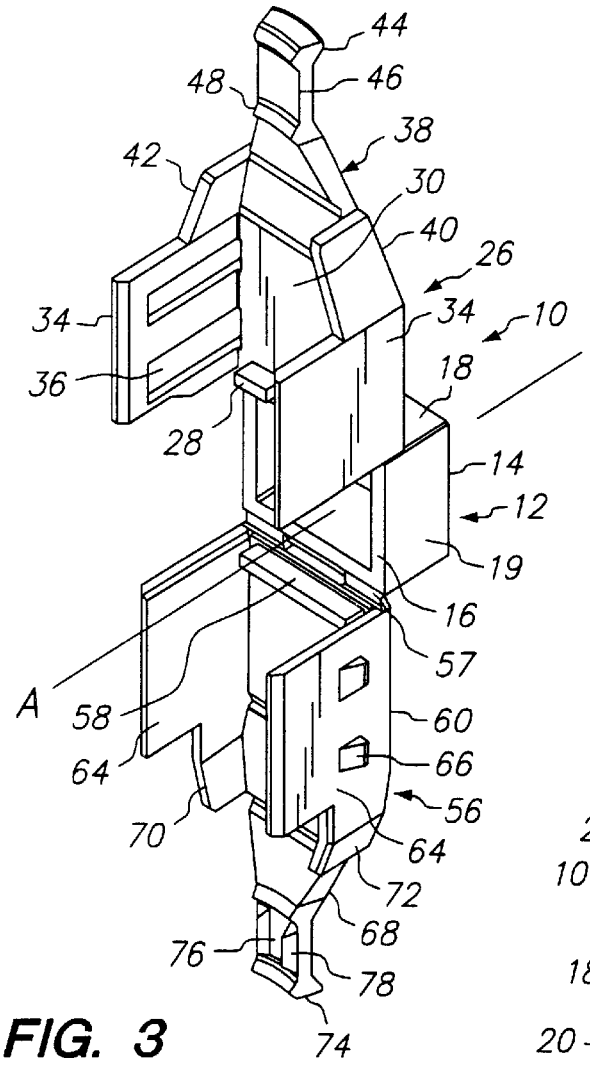
FIG. 3 is an isometric view of the open strain relief assembly viewed from the rear and inside of the assembly.

FIGS. 1 and 2 illustrate a strain relief assembly 10 of the present invention disposed around a representative cable connector 84 and secured to the cable 98 by cable tie 80. For purposes of illustration, cable connector 84 is shown as a connector having a rectangular profile and a latch 90 along one side. It is to be understood that the strain relief assembly 10 of the present invention may be used with cable connectors having shapes other than the one illustrated. It is to be further understood that by changing the configuration of the conductor securing section, the strain relief of the present invention can also be used with a wire bundle.

Figure 4:
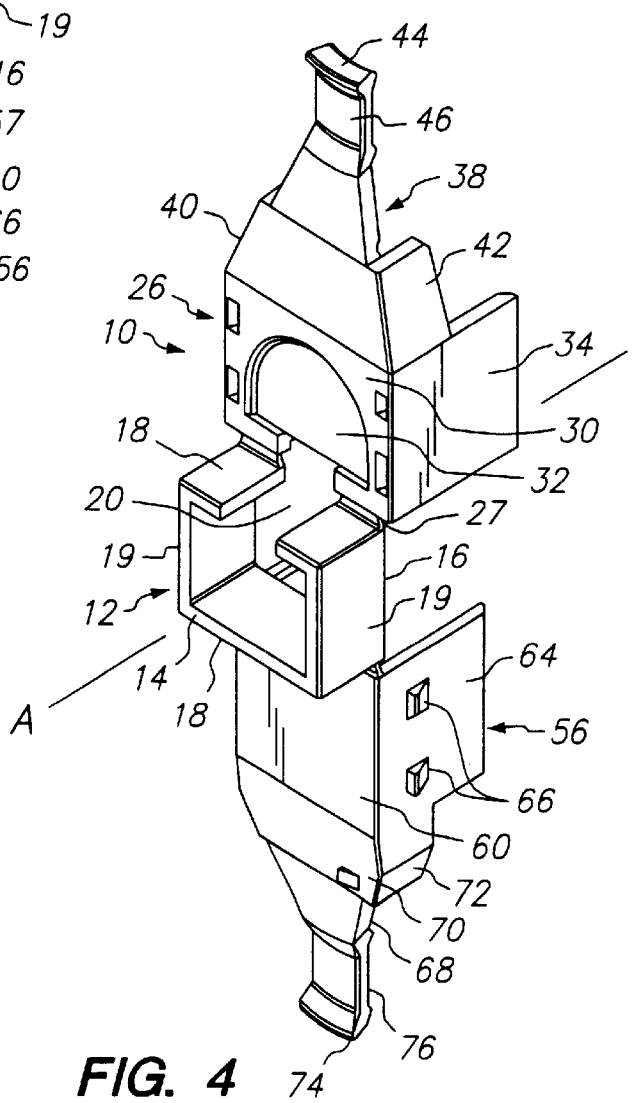
FIG. 4 is an isometric view of the open strain relief assembly viewed from the front and outside of the strain relief.
Figure 5:
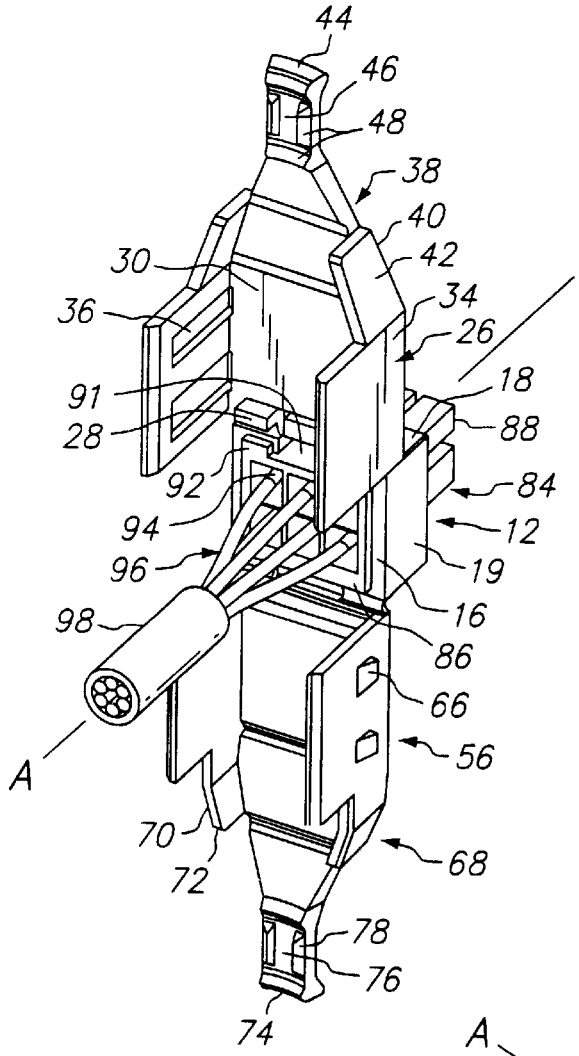
FIG. 5 is a view similar to that of FIG. 3 and including a connector disposed in a frame of the strain relief assembly.
Figure 6:
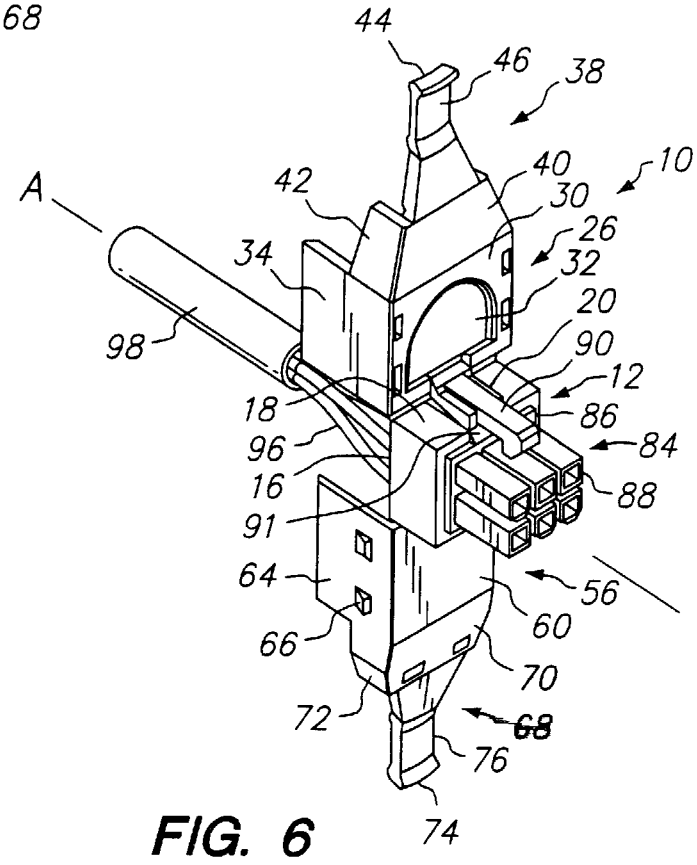
FIG. 6 is a view similar to that of FIG. 4 and including a connector disposed in the frame of the strain relief assembly.
Figure 7:
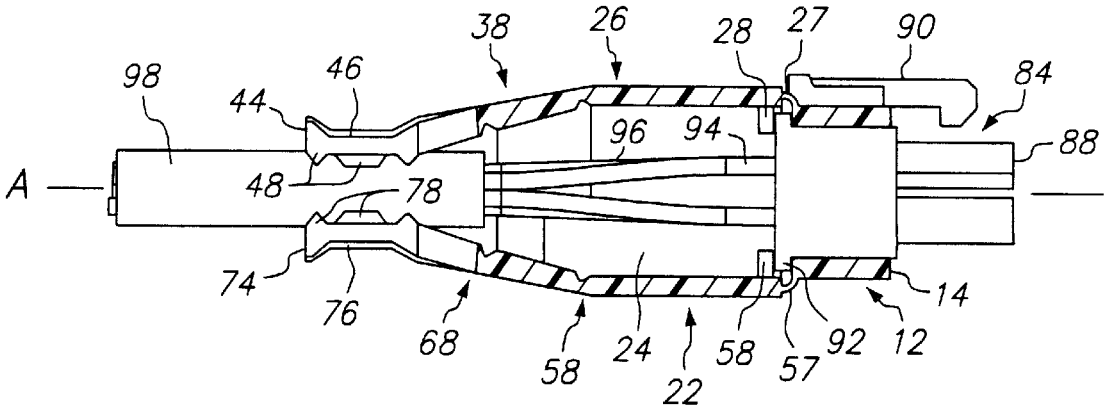
FIG. 7 is a longitudinal sectional view of the strain relief assembly positioned on the connector prior to securing the cable securing arms to the cable.
Figure 8:
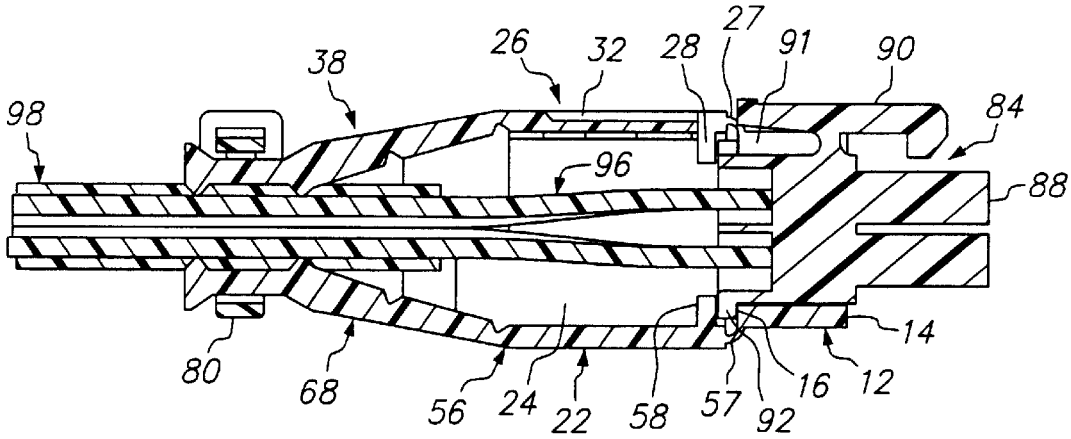
FIG. 8 is a longitudinal sectional view taken along line 8—8 of FIG. 1.

Referring now to FIGS. 1 through 9, strain relief assembly 10 includes a connector receiving frame 12, a wire receiving portion 22 and cable securing arms 38, 68. Connector receiving frame 12 has a forward face 14, a rearward face 16 and two pairs of opposed side walls 18, 19 that are dimensioned to fit securely around connector housing 86 of connector 84. Rearward face 16 is perpendicular to an insertion axis A, as best seen in FIGS. 3 through 6. One wall 18 includes a latch receiving opening 20 dimensioned to receive latch 90 of connector 84, as best seen in FIGS. 2, 4 and 6. Wire receiving portion 22 includes a pair of members 26, 56 each secured to the frame 12 by hinges 27, 57, respectively. In the embodiment shown members 26, 56 are secured to the rearward face 16 of frame 12 in a first, open position wherein the members extend divergently to each other and to the axis of insertion, as shown in FIGS. 3 through 6. The members 26, 56 are movable to a second, closed position in which the members extend in the same direction and are substantially parallel to the insertion axis A, as shown in FIG. 7. It is to be recognized that the members could be secured to the frame at other locations on the frame. The hinged members 26, 56 are securable together to define a wire receiving cavity 24, as best seen in FIGS. 7 and 8. Each of the hinged members 26, 56 includes a hinged wall 30, 60 and opposed side walls 34, 64, respectively. As illustrated, the side walls 34 of hinged member 26 are configured to be positioned outwardly of side walls 64 of hinged member 56 upon securing hinged members 26 and 56 together. The interior surfaces of side walls 34 of hinged member 26 include elongated latch receiving recesses 36 extending from hinged wall 30 toward the leading end of side wall 34. These latch receiving recesses 36 cooperate with corresponding latch protrusions 66 on an adjacent side wall 64 of hinged member 56 to hold the hinged members 26, 56 together, as more fully explained below. To facilitate mating and unmating of the cable connector 84 with a complementary connector (not shown) and the operation of latch 90 of connector 84, the hinged wall 30 of hinged member 26 includes a recessed portion 32 dimensioned to permit a person's thumb or other finger or a tool to depress the latch. Hinged wall 30 further includes a pair of protrusions 28 extending into wire receiving cavity 24 proximate hinge 27 and dimensioned to be disposed behind connector housing 86 upon securing hinged members 26, 56 together.

Figure 9:
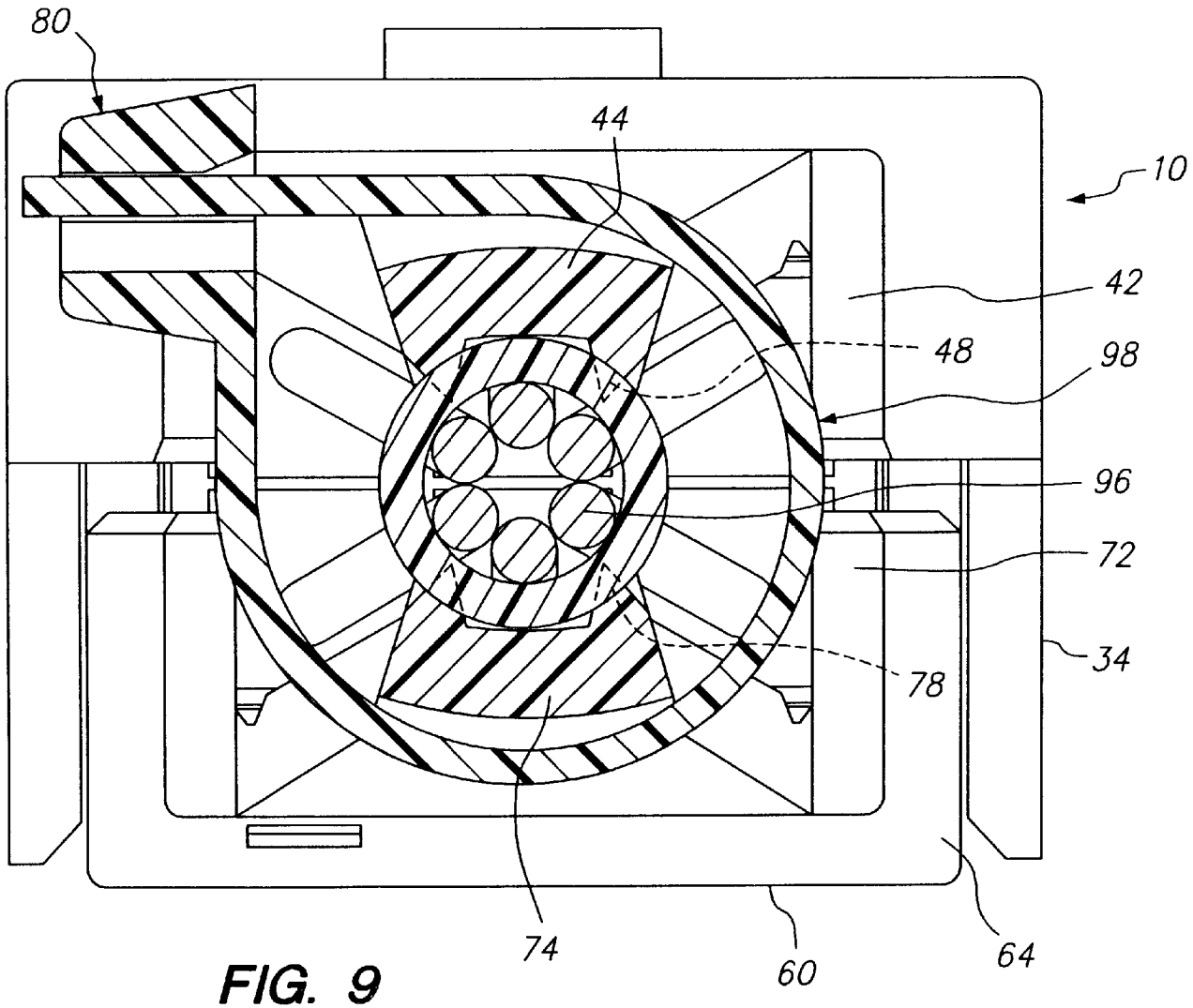
FIG. 9 is a cross-sectional view taken along line 9—9 of FIG. 1.

Cable securing arm 38 extends from hinged wall 30 in a direction away from the frame 12. Cable securing arm 38 includes a tapered first portion 40 including tapered side walls 42 and a narrower tapered second portion 44 having a cable securing section 46 at the leading end thereof. In the embodiment shown cable securing arm 38 is shown as a single member. Depending upon the size and configuration of the connector the arm could be formed of a plurality of sections or a plurality of arms could extend from the hinged member. Cable securing section 46 includes a plurality of protrusions or barbs 48 that are pressed into the insulated cable 98 upon securing the assembly to the cable with a cable tie, as shown in FIGS. 1 and 9. It is to be understood that the assembly may also be configured to be secured by a cable clamp or the like, as known in the art. For purposes of this disclosure it is to be understood that the words "cable tie" include all such devices as known in the art. It is also to be understood that the term "cable" includes a wire bundle as well as a plurality of wires encased in a layer of insulation.

Second hinged member 56 has substantially the same shape as first hinged member 26 except that side walls 64 are dimensioned to be received within side walls 34 of hinged member 26. The inner surface of hinged wall 60 includes at least one protrusion 58 extending into the wire receiving cavity defining a stop surface proximate the hinge 57 that engages a portion 92 of the cable connector housing 86 to prevent rearward movement of the cable connector 84 upon pivoting hinged members 26, 56 about the respective hinges 27, 57 and securing the hinged members 26, 56 together. The outer surface of side walls 64 include latch protrusions 66 that are dimensioned to be received in elongated latch receiving recesses 36 on adjacent side walls 34 of hinged member 26.

Cable securing arm 68 extends from hinged wall 60 such that it is aligned with and spaced from cable securing arm 38 of hinged member 26. Cable securing arm 68 includes a tapered first portion 70 including tapered side walls 72 and a tapered narrower second portion 74 having a cable securing section 76 at the leading end thereof. Again, depending upon the shape and size of the connector used with the strain relief of the invention, the cable securing arm may be formed from a plurality of sections. Cable securing section 76 also includes a plurality of protrusions or barbs 78 for securing the cable as previously discussed. The elongated latch receiving recesses 36 and latch protrusions 66 permit the closed hinged members 26, 56 to move a selected distance substantially parallel to each other while remaining secured together. The resulting distance between the cable securing sections 46, 76, therefore, can be adjusted to accommodate cables having different diameters.

FIGS. 5 through 8 illustrate the steps in attaching strain relief assembly 10 to cable connector 84. Cable connector 84 includes a housing 86 having a mating face 88 and a latch 90 in a recess 91 along one wall thereof and a plurality of terminals 94. Each terminal 94 is terminated to a wire 96 of cable 98, as best seen in FIG. 5. Cable connector 84 is inserted into strain relief assembly 10 along the insertion axis A such that housing 86 is received in frame 12 and the mating face 88 of housing 86 is proximate the forward face 14 of frame 12 with latch 90 being received in latch receiving opening 20, as seen in FIGS. 2 and 6. In the embodiment shown the mating face 88 of housing 86 extends forwardly of the forward face 14. Housing 86 includes outwardly extending portions 92 at the rear face thereof that engage rearward face 16 of frame 12 and define stop surfaces that prevent further forward movement of housing 86. Upon closing hinged members 26, 56, the protrusions 28, 58 engage the back surface of portions 92 to prevent rearward movement of cable connector 84 thereby holding cable connector securely in position, as best seen in FIGS. 7 and 8.

FIG. 7 shows cable connector 84 in position with wires 96 of cable 98 extending into the wire receiving cavity 24 prior to securing the cable securing portions 46, 76 to cable 98. With the cable connector held securely in the frame, the position of the wires 96 may be adjusted prior to securing the cable securing arms 38, 68 to cable 98 with cable tie 80, as shown in FIG. 8. The configuration of wire receiving cavity 24 is such that, if necessary, additional lengths of the discrete wires 96 may be disposed in the wire receiving cavity to assure the cable surrounding portions 46, 76 are secured to the insulated cable. The adjustment of the wires 96 of cable 98 having a long strip length can be accomplished without disturbing the position of cable connector 84. Upon applying the cable tie 80, the barbs 48, 78 are pushed into the insulation of cable 98, thereby securing the cable in position, as illustrated in FIG. 9. The two stage attachment process thereby facilitates attachment of the assembly to the connector and cable.

Figure 10:
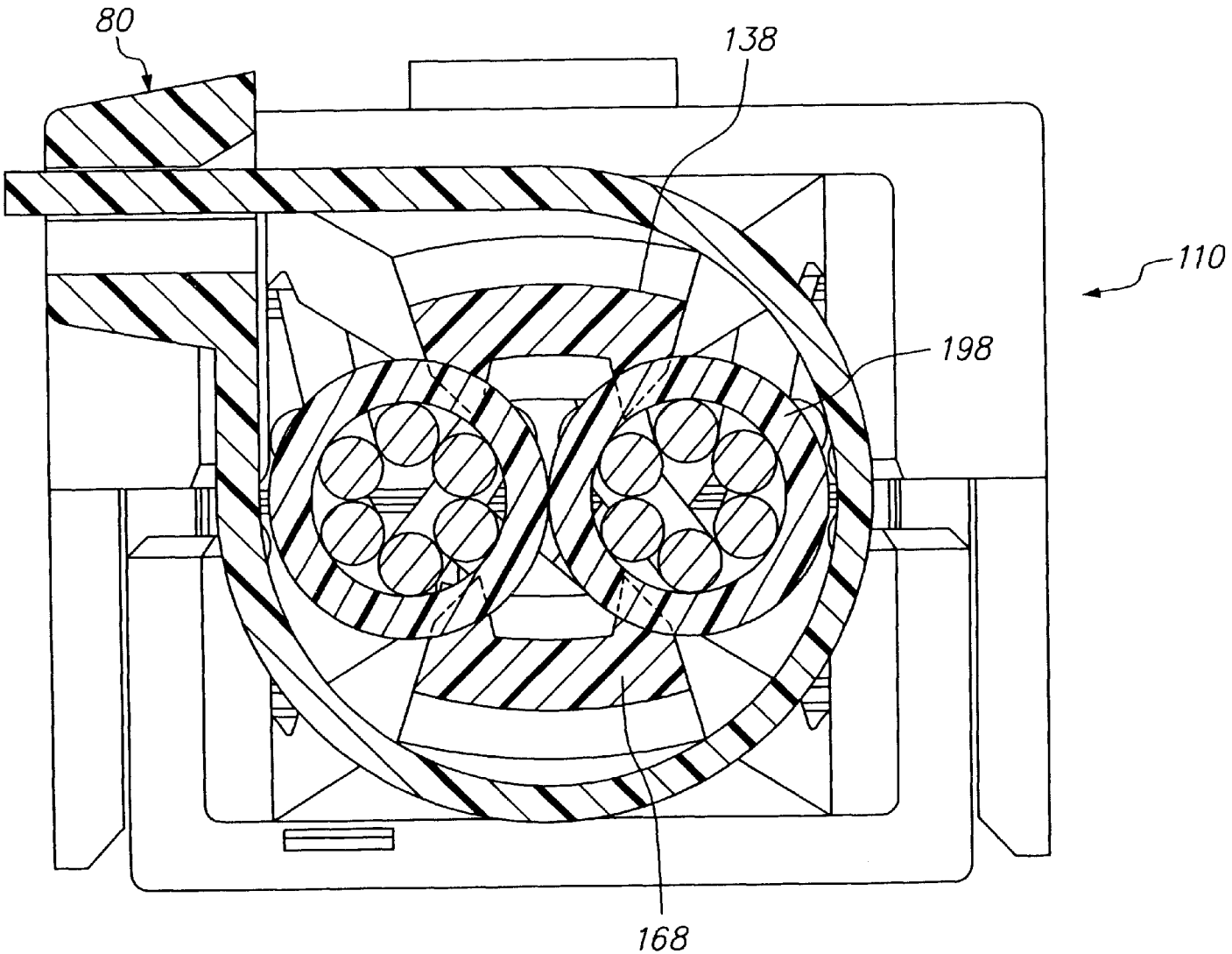
FIG. 10 is a cross-sectional view similar to that of FIG. 9 of the strain relief assembly secured to a connector having two cables extending therefrom.

FIG. 10 illustrates a strain relief assembly 110 made in accordance with the invention used with a cable connector (not shown) having two cables 198 extending therefrom. As can be seen in FIG. 10, the cables 198 are secured in place by the barbs 148, 178 of cable securing arms 138, 168.

The strain relief assembly of the present invention is cost effective to manufacture. The main assembly is molded from a dielectric material having the desired flexibility to accommodate a hinged design, as known in the art. The main assembly is made in a single piece and can be molded in a single action mold. Cable ties are readily available. The strain relief assembly is designed to permit the cable connector to be held securely in position prior to securing the cable tie to the cable securing arms thus allowing the position of the wires and cable to be adjusted, if necessary, and facilitating the attaching process. The strain relief assembly includes a frame that surrounds a portion of the connector thereby eliminating the need to provide special features on a connector housing to which the strain relief assembly can be attached. Additionally the flexibility of the cable securing arms allows the assembly to accommodate connectors having cables having different diameters. The strain relief assembly can be removed from the cable connector by severing the cable tie, or the like and inserting a tool to deflect the side walls outwardly, thereby releasing the latch protrusions from the elongated notches.

It is thought that the strain relief assembly of the present invention and many of its attendant advantages will be understood from the foregoing description. It is apparent that various changes may be made in the form, construction, and arrangement of parts thereof without departing from the spirit or scope of the invention, or sacrificing all of its material advantages.

We claim:

1. A strain relief assembly for an electrical connector having a housing and a plurality of terminals terminated to respective wires of at least one cable extending from the connector, the strain relief assembly comprising:

a connector receiving frame having a forward face and a rearward face perpendicular to an insertion axis, the frame being dimensioned to receive the electrical connector inserted into the frame along the insertion axis;

a pair of members hingedly secured to and extending from the frame wherein in a first, open position the members extend divergently to each other and to the axis of insertion and in a second, closed position the members extend in the same direction and substantially parallel to the insertion axis and being securable together to define a wire receiving cavity; and at least one cable securing arm extending outwardly from each of the hinged members to a leading end, each leading end being dimensioned to surround at least a portion of the at least one cable.

2. The strain relief assembly of claim 1 wherein the hinged members are secured to the rearward face of the frame.

3. The strain relief assembly of claim 1 wherein the frame includes an opening extending through a wall of the frame dimensioned to receive a latch of the electrical connector housing.

4. The strain relief assembly of claim 3 wherein at least one of the walls includes a recessed portion proximate the latch to facilitate operation of the latch.

5. A strain relief assembly for an electrical connector having a housing and a plurality of terminals terminated to respective wires of at least one cable extending from the connector, the strain relief assembly comprising:

a connector receiving frame having a forward face and a rearward face perpendicular to an insertion axis, the frame being dimensioned to receive the electrical connector inserted into the frame along the insertion axis;

a pair of members hingedly secured to and extending from the frame wherein in a first, open position the members extend divergently to each other and to the axis of insertion and in a second, closed position the members extend in the same direction and substantially parallel to the insertion axis and being securable together to define a wire receiving cavity, wherein at least one of the hinged members includes at least one protrusion extending into the wire receiving cavity defining a stop surface that prevents rearward movement of the electrical connector from the assembly upon closing the two hinged members; and at least one cable securing arm extending outwardly from each of the hinged members to a leading end, each leading end being dimensioned to surround at least a portion of the at least one cable.

6. A strain relief assembly for an electrical connector having a housing and a plurality of terminals terminated to respective wires of at least one cable extending from the connector, the strain relief assembly comprising:

a connector receiving frame having a forward face and a rearward face perpendicular to an insertion axis, the frame being dimensioned to receive the electrical connector inserted into the frame along the insertion axis;

a pair of members hingedly secured to and extending from the frame wherein in a first, open position the members extend divergently to each other and to the axis of insertion and in a second, closed position the members extend in the same direction and substantially parallel to the insertion axis and being securable together to define a wire receiving cavity, wherein each of the hinged members include a hinged wall and a pair of opposed side walls such that upon securing the hinged members together the side walls of one of the members are disposed within the side walls of the other of the members; and at least one cable securing arm extending outwardly from each of the hinged members to a leading end, each leading end being dimensioned to surround at least a portion of the at least one cable.

7. The strain relief assembly of claim 6 wherein the wire receiving cavity defined by the closed hinged members has a rectangular profile.

8. The strain relief assembly of claim 6 wherein an inner surface of adjacent outer side walls and an outer surface of the inner side walls are secured together by at least one latch protrusion on one of the adjacent side walls and a cooperating latch receiving recess on the other of adjacent side walls.

9. The strain relief assembly of claim 8 wherein each latch receiving recess is elongated such that the hinged members can move substantially parallel to one another for a selected distance while remaining secured together.

10. A strain relief assembly for an electrical connector having a housing and a plurality of terminals terminated to respective wires of at least one cable extending from the connector, the strain relief assembly comprising:

a dielectric member having a connector receiving portion and a wire receiving portion;

the connector receiving portion defining a frame having a forward face and a rearward face, the frame being dimensioned to receive and surround a portion of the electrical connector inserted into the frame such that a mating face of the connector extends from the forward face of the frame;

the wire receiving portion being a pair of members extending from and hingedly secured to opposite sides of the frame, the members being securable together to define a wire receiving cavity; and at least one cable securing arm extending outwardly from each of the hinged members to a leading end and in a direction substantially parallel to the cable when in a closed position, each leading end being dimensioned to surround at least a portion of the cable and be secured thereto;

whereby upon securing the hinged members together the electrical connector is held securely in the frame while permitting the position of the wires to be adjusted within the wire receiving cavity prior to securing the arms to the at least one cable thus facilitating attachment of the strain relief assembly to the connector and at least one cable.

11. The strain relief assembly of claim 10 wherein the hinged members are secured to the rearward face of the frame.

12. The strain relief assembly of claim 10 wherein each of the hinged members include a hinged wall and a pair of opposed side walls such that upon securing the hinged members together the side walls of one of the members are disposed within the side walls of the other of the members.

13. The strain relief assembly of claim 12 wherein the wire receiving cavity defined by the closed hinged members has a rectangular profile.

14. The strain relief assembly of claim 12 wherein an inner surface of adjacent outer side walls and an outer surface of the inner side walls are secured together by at least one latch protrusion on one of the adjacent side walls and a cooperating latch receiving recess on the other of adjacent side walls.

15. The strain relief assembly of claim 14 wherein each latch receiving recess is elongated such that the hinged members can move substantially parallel to one another for a selected distance while remaining secured together.

16. The strain relief assembly of claim 10 wherein the frame includes an opening extending through a wall of the frame dimensioned to receive the latch of the electrical connector housing.

17. The strain relief assembly of claim 16 wherein at least one of the walls includes a recessed portion proximate the latch to facilitate operation of the latch.

18. A strain relief assembly for an electrical connector having a housing and a plurality of terminals terminated to respective wires of at least one cable extending from the connector, the strain relief assembly comprising:

a dielectric member having a connector receiving portion and a wire receiving portion;

the connector receiving portion defining a frame having a forward face and a rearward face, the frame being dimensioned to receive and surround a portion of the electrical connector inserted into the frame such that a mating face of the connector extends from the forward face of the frame;

the wire receiving portion being a pair of members extending from and hingedly secured to opposite sides of the frame, the members being securable together to define a wire receiving cavity, wherein at least one of the hinged members includes at least one protrusion extending into the wire receiving cavity defining a stop surfacc that prevents rearward movement of the electrical connector from the assembly upon closing the two hinged members; and at least one cable securing arm extending outwardly from each of the hinged members to a leading end and in a direction substantially parallel to the cable when in a closed position, each leading end being dimensioned to surround at least a portion of the cable and be secured thereto;

whereby upon securing the hinged members together, the electrical connector is held securely in the frame while permitting the position of the wires to be adjusted within the wire receiving cavity prior to securing the arms to the at least one cable thus facilitating attachment of the strain relief assembly to the connector and the at least one cable.

19. A strain relief assembly for an electrical connector having a housing and a plurality of terminals terminated to respective wires of at least one cable extending from the connector, the strain relief assembly comprising:

a connector receiving frame having a forward face and a rearward face perpendicular to an insertion axis, the frame being dimensioned to receive the electrical connector inserted into and removed from the frame along the insertion axis;

a pair of members hingedly secured to and extending from the frame wherein in a first, open position the members extend divergently to each other and to the axis of insertion and in a second, closed position the members extend in the same direction and substantially parallel to the insertion axis and being securable together to define a wire receiving cavity; and at least one cable securing arm extending outwardly from each of the hinged members to a leading end, each leading end being dimensioned to surround at least a portion of the at least one cable.

* * * * *